United States Patent [19]

Glickman

[11] Patent Number: 5,061,219

[45] Date of Patent: Oct. 29, 1991

[54] CONSTRUCTION TOY

[75] Inventor: Joel I. Glickman, Huntingdon Valley, Pa.

[73] Assignee: Magic Mold Corporation, Hatfield, Pa.

[21] Appl. No.: 625,809

[22] Filed: Dec. 11, 1990

[51] Int. Cl.[5] ..... A63H 33/04

[52] U.S. Cl. ..... 446/126; 446/120; 446/124

[58] Field of Search ..... 446/85, 118, 120, 124, 446/125, 126

[56] References Cited

U.S. PATENT DOCUMENTS

| | | | |
|---|---|---|---|
| 1,113,371 | 10/1914 | Pajeau | 446/126 |
| 1,608,592 | 11/1926 | Funk . | |
| 1,707,691 | 4/1929 | Sweet | 446/124 XR |
| 1,898,297 | 2/1933 | Fox . | |
| 2,633,662 | 4/1953 | Nelson . | |
| 2,709,318 | 5/1955 | Benjamin | 446/124 XR |
| 2,800,743 | 7/1957 | Meehan et al. . | |
| 2,895,753 | 7/1959 | Fentiman . | |
| 2,976,968 | 3/1961 | Fentiman . | |
| 3,275,351 | 9/1966 | Fentiman . | |
| 3,286,391 | 11/1966 | Mengeringhausen | 446/120 |
| 3,564,158 | 2/1971 | Willis . | |
| 3,626,632 | 12/1971 | Bullock . | |
| 3,891,335 | 6/1975 | Feil . | |
| 4,302,900 | 12/1981 | Rayner | 446/126 XR |

*Primary Examiner*—Robert A. Hafer
*Assistant Examiner*—Sam Rimell
*Attorney, Agent, or Firm*—Schweitzer Cornman & Gross

[57] ABSTRACT

A construction toy is disclosed, which includes as principle components a hub-like connector having one or more gripping sockets, and structural elements, typically of strutlike configuration, having end portions specially configured to be received in the gripping sockets. The gripping sockets are comprised of pairs of gripping arms, formed of deflectable plastic material. Outer portions of the gripping arms are provided with concave grooves adapted for lateral, snap-in assembly of a structural element having complimentary cylindrical connector portions. The gripping arms also are provided, near their inner ends, with locking projections arranged to interlockingly mate with annular recesses provided near the ends of the structural elements. The end extremities of the structural elements comprise end flanges, which are received in an end cavity formed at the closed end of the gripping socket, in part by an end wall of the socket and in part by the locking projections. The novel arrangement of gripping socket and structural element allows lateral snap-in assembly of the structural elements with the connector elements, with the assembled elements being secured against both lateral and axial disassembly. The structural elements are also provided with portions of "X-shaped" cross section, enabling them to be snapped into the gripping recesses and retained therein in an orientation at 90° to the normal orientation. An adapter arrangement is also disclosed, whereby the construction toy may be interfaced with other conventional construction toys.

14 Claims, 2 Drawing Sheets

CONSTRUCTION TOY

BACKGROUND AND SUMMARY OF THE INVENTION

The present invention is directed to construction toys, and more particularly to a novel and improved form of construction toy, comprising hub-like connector elements and strut-like structural elements adapted to be removably engaged with the connector elements to form a composite structure.

A variety of construction toys is known, which are comprised of combinations of connector elements and structural elements which can be combined in various forms to form composite structures.

The device of the present invention, while being of a known general type, incorporates a variety of unique and advantageous features which greatly enhance its performance. At the same time, the device is designed to be mass produced by injection molding techniques, so as to be capable of manufacture on a low cost basis.

In accordance with one aspect of the invention, a hub-like connector element is provided with a plurality of generally radially oriented sockets for receiving and lockingly engaging end portions of typically structural elements of strut-like configuration. The connecting sockets are designed to accommodate lateral snap-in insertion of the structural elements. The end extremities of the structural elements are formed with an annular groove, defining a flanged end. The sockets on the connector elements are defined by spaced pairs of gripping arms, and each arm includes an inwardly protruding locking projection arranged to be received in the annular groove of the structural element. Accordingly, upon lateral snap-in installation of a structural element, it is locked against axial withdrawal from the connector element.

In accordance with another aspect of the invention, the strut-like structural elements, which are desirable molded to be of circular cross section at the ends, are configured, in regions intermediate the ends in a generally X-shaped cross section, within a circular envelope conforming to the circular cross section of the structural element at its ends. The X-shaped cross section of the intermediate regions is arranged for cooperation with the opposed locking projections of the gripping arms such that, when the structural element is oriented at 90° to its "normal" radial orientation in the connector element, it may be pressed laterally between a pair of gripping arms and snapped into locking position, with the locking projections engaging the X-shaped cross section to immobilize the structural element. This adds a significant dimension to the utilization of the device. In selected areas, the structural elements may be provided with spaced pairs of regions of circular cross section interrupting the X-shaped cross section of the structural element and providing means for fixing the axial position of the structural element, when it is mounted in the alternative mode, by engaging of the locking projections with the X-shaped cross section.

The construction toy of the invention also lends itself advantageously to a structural association, through simple adapter elements, with other well known construction toys, such as block-type construction toys sold under the "Lego" trademark.

For a more complete understanding of the above and other features and advantages of the invention, reference should be made to the following detailed description of preferred embodiments and to the accompanying drawing.

DESCRIPTION OF PREFERRED EMBODIMENTS

Figure 1:
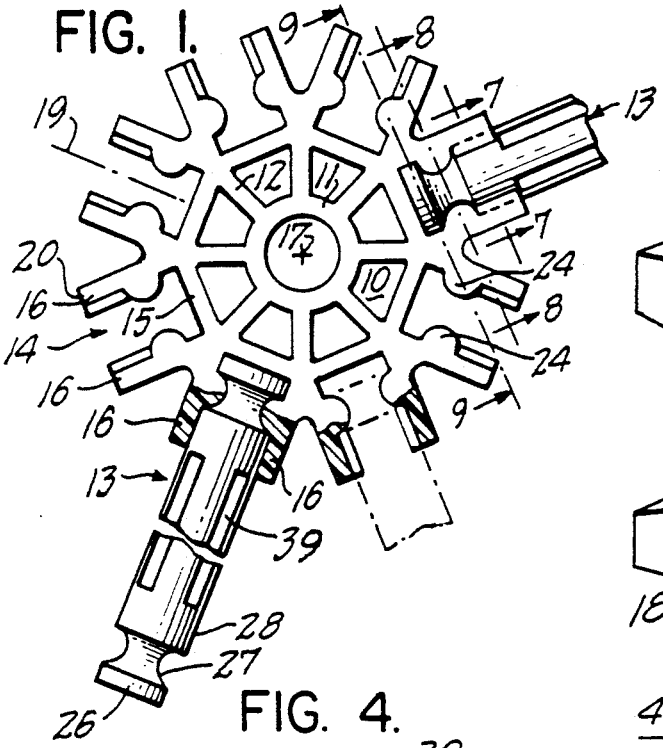
FIG. 1 is an elevational view, partly in section, of a hub-like connector element constructed according to the teachings of the invention, showing the connector element with selected structural elements joined therewith.

Referring now to the drawing, the reference numeral 10 designates a hub-like connector element 10, shown particularly in FIG. 1. In the illustrated form, the connector element includes a central hub cylinder 11 and radiating spokes 12. Although the invention contemplates a variety of connector configurations, the illustrated form provides for the connection of eight, radially disposed structural elements, generally designated by the reference numeral 13. Accordingly, it is advantageous to provide for eight, uniformly spaced, radially extending spoke elements 12.

The radial spokes 12 support an array of eight sockets 14, each comprising an end wall 15 and spaced-apart, opposed gripping elements 16. To advantage, the sockets 14 are radially disposed with respect to the central axis 17 of the connector, and the respective pairs of gripping elements 16 are desirably arranged on opposite sides of the radial axis of the socket, in generally parallel relation to such radial axis.

In accordance with the invention, the gripping elements 16 are provided in their outer portions with concave grooves 18, which are concentric about the radial axis 19 of the socket and extend from the outer end extremities 20 of the gripping elements a suitable distance toward the base wall 15 of the socket, typically about halfway.

The strut-like structural elements 13, to be further described, are of generally cylindrical construction at the their end extremities. Although specific dimensions are not part of the invention, in an advantageous commercial version of the invention, the structural elements may have a nominal diameter of approximately 0.250 inch, for cooperation with concave grooves 18 in the gripping elements formed on a diameter of the same dimension.

Figure 5:
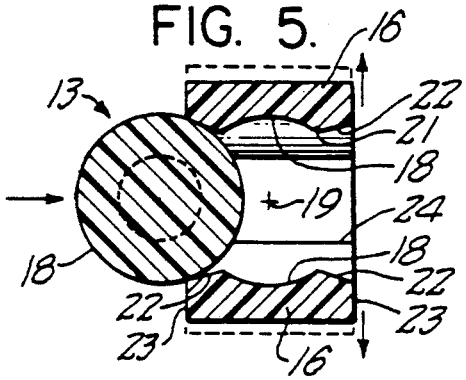
FIGS. 5, 6 and 7 are sequential views, as taken generally on line 7—7 of FIG. 1, showing progressive stages of lateral, snap-in insertion of a structural element into a socket of the connector element of FIG. 1.
Figure 6:
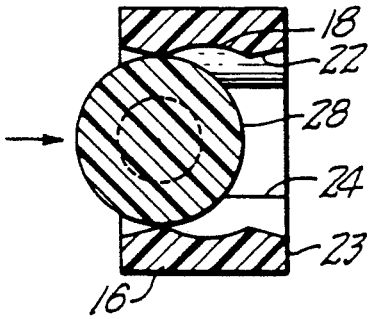
Figure 7:
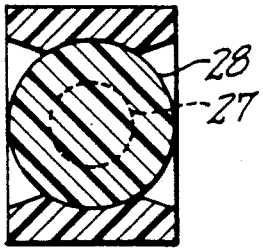
Figure 8:
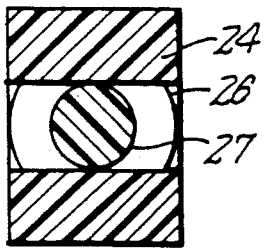
FIGS. 8 and 9 are enlarged, cross sectional views as taken generally on lines 8—8, 9—9 respectively of FIG. 1.
Figure 9:
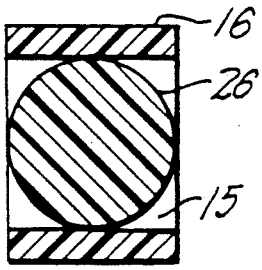

As is apparent in FIG. 5, the arc of the grooves 18 serves to narrow the entrance area 21 to a dimension significantly less than the 0.250 inch diameter of the structural element. In a typical and advantageous embodiment, the dimension at the throat or opening 21 may be on the order 0.210 inch. Accordingly, it is desirable to form the lateral edges 22 of the gripping arms to diverge from the throat 21 to the outer lateral surface 23 of the gripping arm. An angle of divergence of about 15° is appropriate. This facilitates the lateral insertion of the cylindrically configured structural element 13 into the grooves 18 by causing the gripping arm 16 to be laterally displaced and separated, as shown in FIGS. 5 and 6. Once the connecting element is seated in the grooves 18, the gripping arms 16 close snugly about the structural element to retain it in position, as shown in FIG. 7.

As indicated in FIG. 1, each of the gripping arms 16 is provided with a locking projection, desirably of semicylindrical configuration extending along an axis at right angles to the radial axis of the socket defined by the gripping elements. In the illustrated construction, the semicylindrical projections 24 are of generally uniform cross section and extend from one side edge of the gripping arms 16 to the other, as shown best in the enlarged perspective view of FIG. 2.

The locking projections 24 are spaced radially outward a short distance from the base wall 15 of the socket and define therewith a flange-receiving recess 25 at the inner or base end of the socket.

Figure 3:
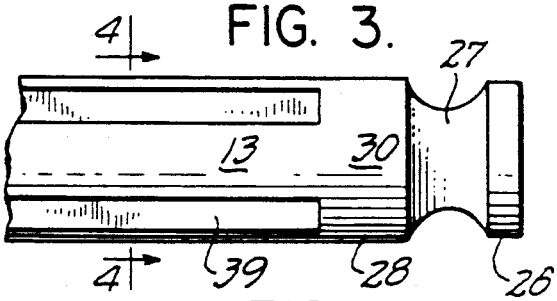
FIG. 3 is an enlarged, fragmentary view of the end portion of a strut-like structural element constructed in accordance with the teachings of the invention.

As shown in FIG. 3, the end extremity of each of the structural elements 13 is configured such that a longitudinal cross section of the end portion of the structural element 13 is approximately the same as the longitudinal cross section of a socket 14, taken along its radial axis in a plane parallel to the flat sides of the connector element. In this respect, the structural elements 13 include cylindrical end flanges 26 of a size and shape to be received in the flange recess 25 of the socket. Immediately adjacent the cylindrical end flange 26 is an annular recess 27 of a semicircular cross sectional configuration adapted to be received within the narrowed space between opposed locking projections 24. Immediately adjacent the annular groove 27 is a cylindrical gripping portion 28, which is adapted to be received in the concave grooves 18 and gripped snugly by the outer portions of the gripping arms 16. The axial length of the gripping portion 26 desirably corresponds to the effective length of the grooves 18.

In the illustrated form of the invention, the cylindrical flange 26 may have an axial length of, for example, 0.62 inch. The annular groove 27 and the locking projections 24 may have a typical radius of approximately 0.62 inch. For structural elements of ¼ inch nominal diameter, a suitable length overall for the gripping sockets 14 is about 0.35 inch.

Figure 10:
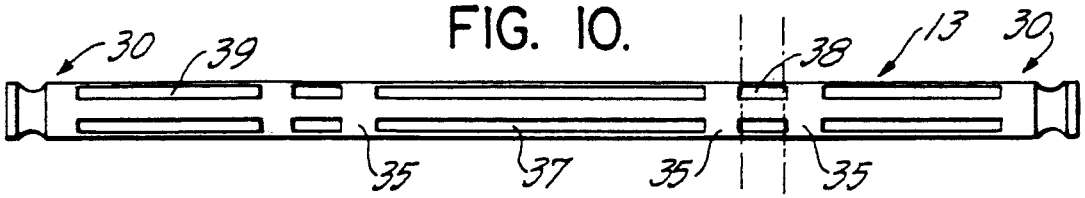
FIG. 10 is an elevational view of a strut-like structural element constructed according to the teachings of the invention, showing portions of X-shaped cross section interrupted by portions of circular cross section along the length of the element.

A typical form of strut-like structural element 13 is shown in FIG. 10. The element may of course be of any length, and a typical construction toy set incorporating principles of the invention would utilize large numbers of such elements, of various appropriate lengths. To particular advantage, portions of the structural element between its respective end portions 30 are of an X-shaped cross sectional configuration, comprised of ribs 31, extending radially, typically at 90° angular intervals and preferably with the external surfaces 32 of the ribs lying on the cylindrical envelope of the element as defined by its cylindrical end portions.

Figure 11:
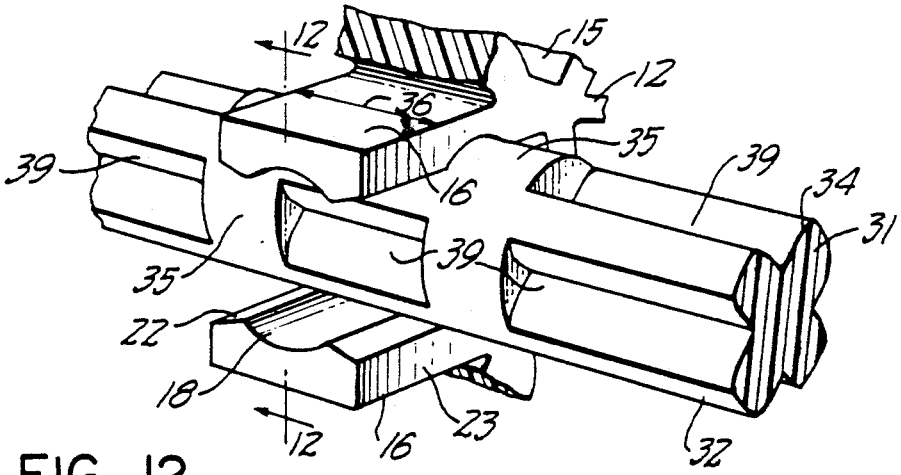
FIG. 11 is a highly enlarged, fragmentary perspective view showing the structural element of FIG. 10 installed in a socket of a connector element at right angles to the normal radial orientation.
Figure 12:
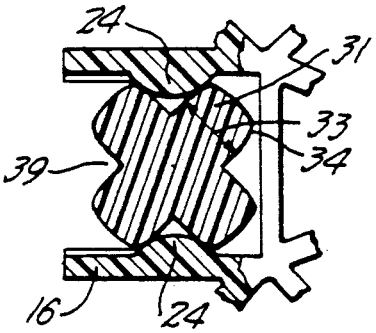
FIG. 12 is a transverse cross sectional view as taken generally on line 12—12 of FIG. 11.

By properly dimensioning the thickness 33 of the ribs 31, and slightly beveling the outer sidewall portions thereof, as indicated at 34, the structural element is able to be pushed laterally into the open end of a radial socket 14 and forced between a pair of opposed locking projections 24, as reflected in FIGS. 11 and 12, seating the projections in recesses 39 between adjacent ribs. This enables the structural element to be rigidly locked in a crosswise orientation in the radial socket, significantly increasing the usefulness of the device as a construction toy.

To particular advantage, the X-shaped cross section of the structural element is periodically interrupted by one or more spaced-apart pairs of cylindrical portions 35. The spacing between these cylindrical portions is approximately equal to the width dimension 36 of the gripping arms 16. Accordingly, when the structural element is aligned with a radial socket 14, with a spaced-apart pair of cylindrical sections 35 closely straddling its gripping arms, and the structural element is snapped into locked position on the projections 24, as shown in FIGS. 11 and 12, the structural element is locked in position axially, laterally and rotationally. Alternatively, if the structural element is applied laterally into the radial socket 14 in one of its areas 37 in which adjacent cylindrical sections 35 are widely spaced, it is possible to adjust the position of the structural element along its axis, within limits.

Figure 4:
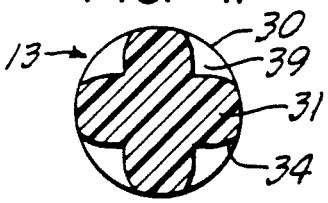
FIG. 4 is a cross sectional view as taken on line 4—4 of FIG. 3.

In a specifically advantageous embodiment of the invention, the width of the ribs 31 may be on the order of 0.93 inch, tapered convergently in the outer portions, as is reflected particularly in FIG. 4. It will be understood that "X-shaped" configuration of the structural elements 13 is not limited in principle to the use of two pairs of ribs. For example, three pairs of ribs may be arranged at 60° angular spacing. Accordingly, the term "X-shaped", as used herein is to be interpreted as encompassing such alternatives.

As will be appreciated, the defined areas 38, between closely spaced pairs of cylindrical portions 35, constitute preferred locations for crosswise assembly of the structural elements to the connector elements to the connector elements. As many of these preferred locations may be provided along the length of the structural element as is appropriate to the overall length of the element. To advantage, certain standard spacings may be provided, so that structural elements of various lengths may be readily employed in a complex assembly, always providing for standard preferred locations for the crosswise assembly of the structural elements to be connecting elements.

The construction toy of the invention may advantageously coupled with structures made of other popular construction toys, particularly block-type construction toys such as sold under the "Lego" trademark, for example.

Figure 14:
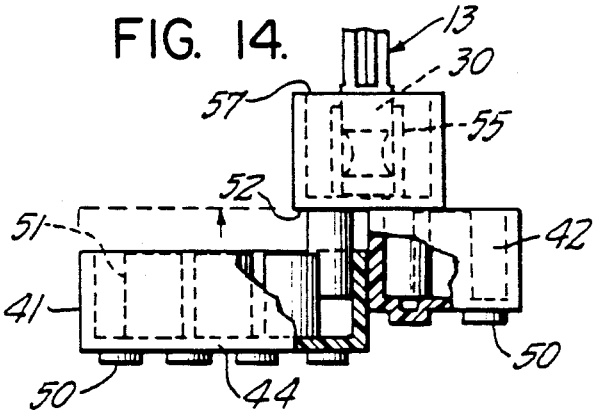
FIG. 14 is an elevational view, partly in section, illustrating the manner in which the adapter block of FIG. 13 is utilized to integrate the device with block-type construction toys of known design.
Figure 13:
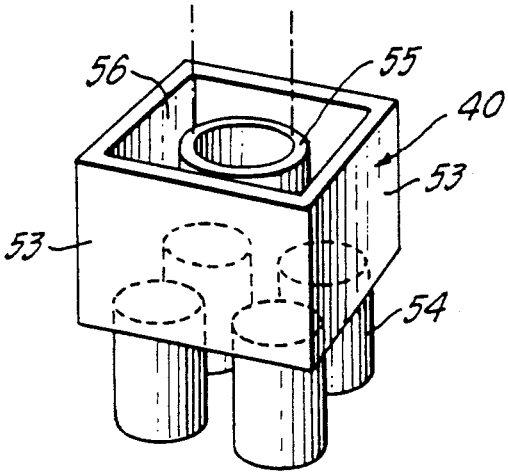
FIG. 13 is a bottom perspective view of an adapter block element, advantageously incorporated with the construction toy of FIGS. 1—12, for integrating the construction toy with certain popular, block-type construction toys.
Figure 15:
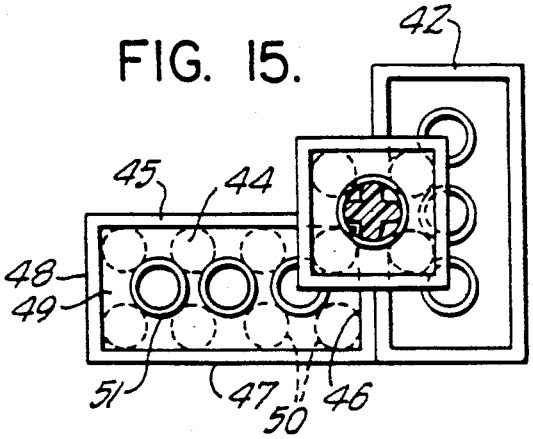
FIG. 15 is a top plan view of the assembly of FIG. 14.

As reflected in FIGS. 13–15, the present invention provides an adapter element, generally designated by the reference numeral 40, of block-like configuration, which is adapted to interface between conventional block-type construction elements and the construction toy elements of the present invention.

In FIGS. 14 and 15, for example, elements 41, 42 are block-like construction elements of a known type, constructed in the form of an open-sided block provided with a "top" wall 44 and sidewalls 45–48 forming an open cavity 49. In the illustrated arrangement, the top wall 44 is provided with a plurality (eight in the illustration) of short circular projections 50. Also extending from the top wall 44 through the cavity 49 are three elongated tubular friction posts 51. In accordance with known design of the block-type construction elements 41, 42, the internal dimensions of the cavity 49 are such as to fit snugly about the external projections 50. In addition, the friction posts 50 are dimensioned to have tangential contact with the sides of the projections 50 when construction blocks are placed one atop the other. This enables, in a known manner, the plurality of construction blocks to be frictionally assembled to form a composite structure.

The adapter block 40 is arranged to provide means for interfacing construction toy elements as previously described herein to a structure of block-type elements 41, 42 of the known type.

The adapter block 40 includes a "top" wall 52 and sidewalls 53. In the illustrated arrangement, the adapter block is of square configuration, but other configurations are possible within the contemplation of the invention. Projecting from the top wall 52 are four elongated cylindrical projections 54 of a diameter and spacing corresponding to the short circular projections 50 of the construction blocks 41, 42. These cylindrical projections 54 may be inserted into the open cavity 49 of a construction block and desirably are of a length corresponding generally to the depth of the cavity 49. In general, the structural features of the adapter block are entirely consistent with those of the known block-like construction elements, except that the projections 54 are of significantly greater length, in order to provide additional structural support.

A tubular adapter sleeve 55 extends from the underside of the "top" wall 52, through the open cavity 56 in the adapter block. The internal diameter of the tubular sleeve is such as to snugly receive an end portion 30 of a structural element 13, as shown in FIG. 14. To advantage, the length of the tubular sleeve 55 is such that it is recessed below the open edge 57 of the adapter block sidewalls a distance corresponding to the height of the circular projections 50 of the construction blocks. Accordingly, where desired, the open side of the adapter block may be assembled with a conventional construction block in an otherwise known manner.

The elements of the construction toy of the invention are adapted readily for high production injection molding of the component parts of a suitable plastic material. A variety of such plastic materials are suitable for the purpose, it being necessary, of course, to select a material having a reasonable degree of strength and elasticity to enable proper functioning of the gripping arms, for example, over numerous assembly and disassembly operations. A material known to be suitable for the purpose is "Celcon M270", an acetal copolymer made available by Hoechst Celanese, Chatham, N.J.

The construction toy of the invention is highly suitable for manufacture by low cost, injection molding procedures. Accordingly, it is feasible to market the toy in construction sets containing large numbers and varieties of parts. This allows for the user to form a large variety of composite structures with a construction set of limited cost.

By enabling the hub-like connector elements to be joined with structural elements by a lateral snap-together action, it becomes more practical to assemble large and complex structures, because the center-to-center distance between component elements does not have to be altered during joining of the components. By contrast, where assembly of the components requires axial insertion of one part into another, center-to-center distances are temporarily enlarged, which at best requires great care and at worst may make it impossible to assemble certain types of structures.

The arrangement of the invention provides a unique two-way gripping action between the hub-like connector elements and the structural elements, wherein the outer, deflectable portions of the gripping arms 16 provide lateral containment, while the innermost portions of the gripping arms form a relatively non-deflectable flange-receiving cavity which freely admits the end flange 26 of the structural element during lateral assembly, but provides positive restraint against axial movement of the structural element.

Figure 2:
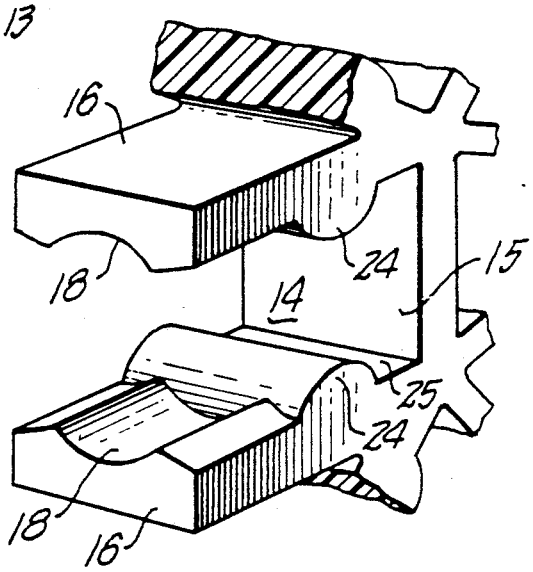
FIG. 2 is a greatly enlarged, fragmentary, perspective view of a portion of the connector element of FIG. 1, illustrating an opposed pair of gripping arms forming a socket for the reception of a structural element.

It should be understood, of course, that the specific forms of the invention herein shown are intended to be representative only, as certain changes may be made therein without departing from the clear teachings of the disclosure. For example, while a strut-like or rod-like form of structural element 13 is typical and preferred, elements of other shape may be employed, utilizing the illustrated end portion 30 for joining with the connector element 10. Likewise, the connector element itself may assume a wide variety of configurations providing in each case one or more of the sockets 14, as generally shown in FIG. 2. Accordingly, reference should be made to the following appended claims in determining the full scope of the invention.

I claim:

1. A construction toy of the type comprising a plurality of hub-like connector elements and a plurality of structural elements adapted to be removably engaged with said connector elements to form a composite structure, characterized by (a) said connector elements including a plurality of opposed pairs of integral, outwardly extending and spaced apart gripping arms, (b) each of said pairs of gripping arms defining an axis and being adapted to receive an end extremity of a structural element aligned along said axis, (c) said structural elements having an axis and having adjacent said end extremity an annular groove coaxial with the last mentioned axis and defining an end flange, (d) each of the gripping arms of a pair thereof being formed with a locking projection extending into the space between said gripping arms and being of a size and shape to be received in the annular groove of a structural element to lock the element against movement in the direction of its axis, (e) each of the gripping arms of a pair thereof further having concave recesses extending in a direction parallel to the axis of said arms and adapted to closely embrace end portions of a structural element on opposite sides thereof to confine said structural element against lateral movement relative to said gripping arms, (f) said gripping arms being formed of a material having at least limited resilience to enable the gripping arms of a pair thereof to be elastically deflected to accommodate lateral insertion of a structural element into the space between a pair of gripping arms.

2. A construction toy according to claim I, further characterized by, (a) said connector elements comprising a plurality of pairs of said gripping arms arranged to extend radially outward from the center of said hub-like connector element.

3. A construction toy according to claim 1, further characterized by, (a) said structural elements having a generally circular cross section in the region of the end extremities thereof, (b) the spacing between pairs of gripping arms being less than the diameter of said circular cross section, (c) the contours of the concave recesses of said gripping arms corresponding generally to the circular contours of said structural elements.

4. A construction toy according to claim 3, further characterized by, (a) a portion of said Hub-like connector element extending between the gripping arms of each pair at their inner ends and defining with said gripping arms a generally U-shaped recess for the lateral reception of an end portion of a structural element, (b) The cross sectional configuration of said recess, taken along its longitudinal axis, and in a plane bisecting said gripping arms, being generally in close conformity to the longitudinal cross sectional configuration of an end portion of a structural element.

5. A construction toy according to claim 1, further characterized by, (a) the lateral edges of said gripping arms being tapered to form an outwardly divergent opening for the lateral reception of a structural element into gripping engagement with said arms.

6. A construction toy according to claim 1, further characterized by, (a) said locking projections being of arcuate convex configuration and extending generally from one edge of a gripping arm to the other, (b) the annular groove in said structural element having a cross sectional configuration to closely receive said locking projections, whereby said structural element is thereby locked against separation from said connector element in the direction of the axis of said structural element.

7. A construction toy according to claim 6, further characterized by, (a) said structural elements being rotatable about their axes while being held between a pair of said gripping arms.

8. A construction toy according to claim 1, further characterized by, (a) said connector elements being of generally flat, generally circular configuration and having a plurality of pairs of gripping arms arrayed radially at regular angular spacings, (b) said connector elements further being provided with a central opening of a size and shape to receive a structural element in an axial direction.

9. A construction toy according to claim 1, further characterized by, (a) said structural elements being of generally circular cross section over at least a portion of their length, (b) said structural elements being of generally "X" cross section, within the envelope of said generally circular cross section, over at least a portion of their length, (c) said portions of generally "X" cross section being receivable in the space between a pair of said gripping arms while said structural elements are disposed at right angles to the axis of said gripping arms, (d) said structural element being adapted to be forced laterally between a pair of opposed locking projections on said gripping arms and being thereby lockingly gripped by said projections.

10. A construction toy according to claim 9, further characterized by, (a) said structural elements having one or more pairs of spaced-apart portions of generally circular cross section and a gripping portion extending therebetween of generally "X" cross section, (b) said spaced-apart portions of a pair being separated by a distance as great as but not substantially greater than the width of said gripping arms whereby, when said structural element is inserted between a pair of gripping arms at right angles to the axis thereof and held therein by interengagement of said locking projections and said gripping portion, said structural element is locked in said connector element against axial movement.

11. A construction toy of the type comprising a plurality of hub-like connector elements and a plurality of structural elements adapted to be removably engaged with said connector elements to form a composite structure, wherein (a) each connector element having at least one open-ended recess for receiving and retaining a structural element by its end, (b) each said recess having an inner end wall and a pair of spaced-apart side walls defining an axis extending between said side walls, (c) integral locking projections extending inwardly from each of said side walls, (d) said locking projections being spaced from said inner end wall and defining with said end wall a first locking chamber, (e) said side walls being formed with concave grooves therein extending from said locking projections toward the open end of said recess, (f) said concave grooves being generally coaxial with said axis, and an opposed pair of said grooves defining a second locking chamber, (g) at least one end portion of said structural elements being shaped to be confined within a generally cylindrical envelope, (h) said end portion defining an axis of said structural element and having a locking flange at the end extremity, receivable laterally within said first locking chamber and being locked therein against movement in the direction of the axis of said structural element, (i) said end portion further having an annular groove immediately adjacent and partly defining said locking flange, (j) said annular groove being adapted to receive said locking projections when said structural element is inserted laterally into said open ended recess, (k) said concave grooves being shaped and positioned to closely receive portions of the cylindrical envelope of said structural element, and (l) said side walls being elastically deflectable to accommodate lateral insertion of said structural element into said recess.

12. A construction toy according to claim 11, further characterized by, (a) said structural elements being or elongated, strut-like configuration and being of circular cross section in the end regions thereof embraced by said concave grooves.

13. A construction toy according to claim 12, further characterized by, (a) said structural elements being of a generally "X" cross sectional configuration over portions of their length, (b) said portions of generally "X" cross sectional configuration being lockingly engageable within said recesses by said locking projections when said structural elements are oriented at right angles to the axes of said recesses.

14. A construction toy according to claim 13, further characterized by, (a) said structural elements being formed along their length with alternating portions cf generally circular and generally "X" shaped cross sectional configuration.

* * * * *